United States Patent [19]

Bauer

[11] 3,967,063

[45] June 29, 1976

[54] LOGIC FOR MATRIX SYSTEMS FOR REPRODUCING QUADRAPHONIC SOUND

[75] Inventor: Benjamin B. Bauer, Stamford, Conn.

[73] Assignee: CBS Inc., New York, N.Y.

[22] Filed: Mar. 3, 1975

[21] Appl. No.: 554,422

Related U.S. Application Data

[63] Continuation of Ser. No. 351,938, April 17, 1973, abandoned, which is a continuation-in-part of Ser. No. 177,003, Sept. 1, 1971, abandoned, and a continuation-in-part of Ser. No. 155,976, June 23, 1971, Pat. No. 3,798,373.

[52] U.S. Cl. ..... 179/1 GQ; 179/100.4 ST; 179/100.1 TD

[51] Int. Cl.[2] ..... H04R 5/00

[58] Field of Search ..... 179/1 GQ, 1 G, 15 BT, 179/100.1 TD, 100.4 ST

[56] References Cited

UNITED STATES PATENTS

| | | | |
|---|---|---|---|
| 3,632,886 | 1/1972 | Scheiber | 179/1 GQ |
| 3,708,631 | 1/1973 | Bauer et al. | 179/1 GQ |
| 3,746,792 | 7/1973 | Scheiber | 179/1 GQ |
| 3,821,474 | 6/1974 | Ohsawa | 179/1 GQ |
| 3,825,684 | 7/1974 | Ito et al. | 179/1 GQ |

*Primary Examiner*—Douglas W. Olms
*Attorney, Agent, or Firm*—Spencer E. Olson

[57] ABSTRACT

Apparatus for decoding four separate channels of information transmitted on two channels or transduced from a medium having only two separate tracks and presenting it on four loudspeakers to give the listener the illusion of sound coming from a corresponding number of separate sources. The realism is enhanced by a decoding matrix which accepts the two outputs from the medium, which may be a stereophonic disc record, separates them into four independent channels each respectively carrying predominantly the information contained in one of the four original recorded sound signals, and, utilizing a logic network which senses the signal amplitudes and phase positions, derives control signals for controlling the gains of amplifiers associated with the four loudspeakers. The logic control circuitry improves the realism of four independent channels by essentially eliminating undesired cross-talk which may accompany the signals produced by the decoding matrix.

35 Claims, 10 Drawing Figures

INVENTOR.
BENJAMIN B. BAUER

BY Spencer E. Olson
ATTORNEY

| BEARING | $L'_f$ | $R'_f$ | $L'_b$ | $R'_b$ |
|---|---|---|---|---|
| 0 | .707 → | .707 → | .707 ↘ | .707 ↖ |
| 22.5 | .383 → | .924 → | .707 ↘ | .707 ↖ |
| 45 | 0 | 1.000 → | .707 → | .707 ↑ |
| 67.5 | .271 ← | .963 ↘ | .653 → | .757 ↗ |
| 90 | .500 ← | .866 ↘ | .500 → | .866 ↗ |
| 112.5 | .653 ← | .757 ↘ | .271 → | .962 ↗ |
| 135 | .707 ← | .707 ↓ | 0 | 1.000 → |
| 157.5 | .707 ↖ | .707 ↘ | .383 → | .923 → |
| 180 | .707 ↖ | .707 ↘ | .707 → | .707 → |
| 202.5 | .707 ↖ | .707 ↘ | .924 → | .381 → |
| 225 | .707 ↑ | .707 → | 1.000 → | 0 |
| 247.5 | .757 ↗ | .653 → | .962 ↘ | .272 ← |
| 270 | .866 ↗ | .500 → | .866 ↘ | .500 ← |
| 292.5 | .963 ↗ | .271 → | .757 ↘ | .654 ← |
| 315 | 1.000 → | 0 | .707 ↓ | .707 ← |
| 337.5 | .924 → | .383 → | .707 ↘ | .707 ↖ |
| 360 | .707 → | .707 → | .707 ↘ | .707 ↖ |

FIG. 2

INVENTOR,
BENJAMIN B. BAUER

BY Spencer E. Olson
ATTORNEY

INVENTOR.
BENJAMIN B. BAUER

BY

Spencer E. Olson

ATTORNEY

INVENTOR.
BENJAMIN B. BAUER

BY Spencer E. Olson
ATTORNEY

| I | II | III | IV | V | VI | VII | VIII | IX | X | XI | XII |
|---|---|---|---|---|---|---|---|---|---|---|---|
| AZIMUTH | $L_T$ $L'_F$ | $R_T$ $R'_F$ | $L'_B$ | $R'_B$ | $L''_F$ | $R''_F$ | $L''_B$ | $R''_B$ | $\Delta F°$ | $\Delta B°$ | $\Delta°$ |
| 0° | .71 | .71 | .50 .71 .50 | .50 .71 .50 | .88 | .88 | .38 45° .38 | .38 45° .38 | 0 | 180 | +180 |
| 22 1/2° | .38 | .92 | .71 .27 .65 | .21 .71 .65 | .61 | 1.01 | .11 11° .58 | .58 11° .11 | 0 | 112 | +112 |
| 45° | 0 | 1.00 | .71 | .71 | .25 | 1.00 | .18 .71 22° | 22° .71 .18 | 0 | 46 | +46 |
| 67 1/2° | .30 | .95 | .46 | .88 | .30 39° .24 | .95 4° .07 | .22 .46 25° | 7° .88 .11 | 47 | 58 | +11 |
| 90° | .38 | .92 | .38 | .92 | .38 31° .23 | .92 6° .09 | .23 .38 31° | 6° .92 .09 | 53 | 53 | 0 |
| 112 1/2° | .54 | .84 | .21 | .98 | .54 21° .21 | .84 9° .13 | .24 .22 49° | 3° .98 .05 | 60 | 38 | −22 |
| 135° | .71 | .71 | 0 | 1.00 | .71 22° .18 | .71 .18 22° | .25 | 1.0 | 46 | 0 | −46 |
| 157 1/2° | .65 .71 .27 | .71 .27 .65 | .27 .38 .27 | .65 .92 .65 | .49 35° .34 | .34 .47 35° | .43 45° .43 | .72 45° .72 | 110 | 0 | −110 |
| 180° | .50 .71 .50 | .50 .71 .50 | .71 | .71 | .38 45° .38 | .38 45° .38 | .88 | .88 | 180 | 0 | −180 |

FIG. 6A

LOGIC FOR MATRIX SYSTEMS FOR REPRODUCING QUADRAPHONIC SOUND

This is a continuation of now abandoned application Ser. No. 351,938, filed Apr. 17, 1973 as a continuation-in-part of application Ser. No. 177,003 filed Sept. 1, 1971, now abandoned, and of application Ser. No. 155,976, filed June 23, 1971, now U.S. Pat. No. 3,798,373, both in the name of Benjamin B. Bauer.

CROSS-REFERENCE TO OTHER APPLICATIONS

This invention is related to the subject matter of co-pending applications Ser. No. 124,135, filed Mar. 15, 1971, now U.S. Pat. No. 3,821,471, and Ser. No. 328,814 filed Feb. 10, 1973 now abandoned in favor of Ser. No. 384,334 now U.S. Pat. No. 3,890,466 filed July 31, 1973, both of which are assigned to the assignee of the present application.

BACKGROUND OF THE INVENTION

This invention relates to systems for recording and reproducing four separate channels of information on a medium having only two independent tracks, and more particularly to apparatus for reproducing such information and presenting it on four loudspeakers to give the listener the illusion of sound coming from a corresponding number of separate sources. More specifically, the present invention is concerned with an improved logic for multichannel matrix decoding systems of the type described in the above-mentioned co-pending applications for improving the realism of the reproduced sound.

Briefly, in a matrixed quadraphonic system several channels of sound, say four, are combined by an encoding matrix into two channels whereby they may be recorded on a two-channel medium, such as a disc record, or transmitted over two channels, such as FM-multiplex radio. A suitable encoder for this purpose is illustrated in FIG. 8 of the aforementioned U.S. Pat. No. 3,821,471, and in application Ser. No. 384,334. To recover as best as possible the original four channels, the two composite signals are applied to a decoding matrix which is operative to produce four new signals each predominantly containing one of the original four signals, but also containing fractional portions of others of the original signals transferred from the original channels to the adjacent or opposite channels; the fractional signals are referred to hereinafter as side-effect signals. For some directions of sound arrival to be portrayed by the four-channel array the side-effect signals are harmless; in other cases, however, they tend to diminish the realism of the original four-channel sound. In order to counteract the effect of the side-effect signals, variable-gain amplifiers are used in the four output channels, and a logic network is provided to sense the presence of the desired signals and/or the presence of transferred side-effect signals and to develop control signals for adjusting the gains of the variable-gain amplifiers rapidly and continuously in response to program sounds in a manner to diminish or eliminate the perception of side-effect signals. The aforementioned U.S. Pat. No. 3,821,471 discloses a logic network whose action is based on wave-matching and amplitude comparison techniques. Although this previous decoder produces good channel separation and substantially eliminates side-effect signals, the circuitry is relatively complex, and consequently more expensive, and is not as readily adaptable to implementation by integrated solid-state techniques as would be desired.

It is a primary object of the present invention to obtain equal or greater quadraphonic realism than that attainable by the logic circuitry described in the aforementioned co-pending applications while, at the same time, simplifying and reducing the cost of the circuitry for accomplishing it. A more specific object is to provide a logic network which is readily adaptable to integrated circuit implementation.

SUMMARY OF THE INVENTION

The foregoing and other objects of the invention are achieved by an improved logic for controlling the gains of the four output amplifiers of the decoder in response to signals appearing at the output terminals of a matrix decoder to enhance the realism of four-channel reproduction. It being a characteristic of the above-outlined system that the four signals produced by the decoder matrix have phases uniquely related to the bearing angle at which the original signals are applied to the encoder, the logic is designed to sense the signal phase positions, the latter property being ascertainable from the zero-axis crossings of the signals. That is, the logic senses the presence of side-effect signals in a different manner than is employed in the logic circuits described in the aforementioned applications, but has the common general function of producing control signals for varying the gains of the appropriate amplifiers to enhance the predominant signals relative to the side-effect signals.

BRIEF DESCRIPTION OF THE DRAWINGS

Other objects, features and advantages of the invention will become apparent, and its construction and operation better understood, from the following detailed description, taken in conjunction with the accompanying drawings, in which:

FIG. 2 is a chart showing the magnitude and phase of the output signals appearing at the four output terminals of the decoder of FIG. 1 as a function of the bearing angle at which the original signals are applied to the encoder;

DESCRIPTION OF THE PREFERRED EMBODIMENTS

Figure 1:
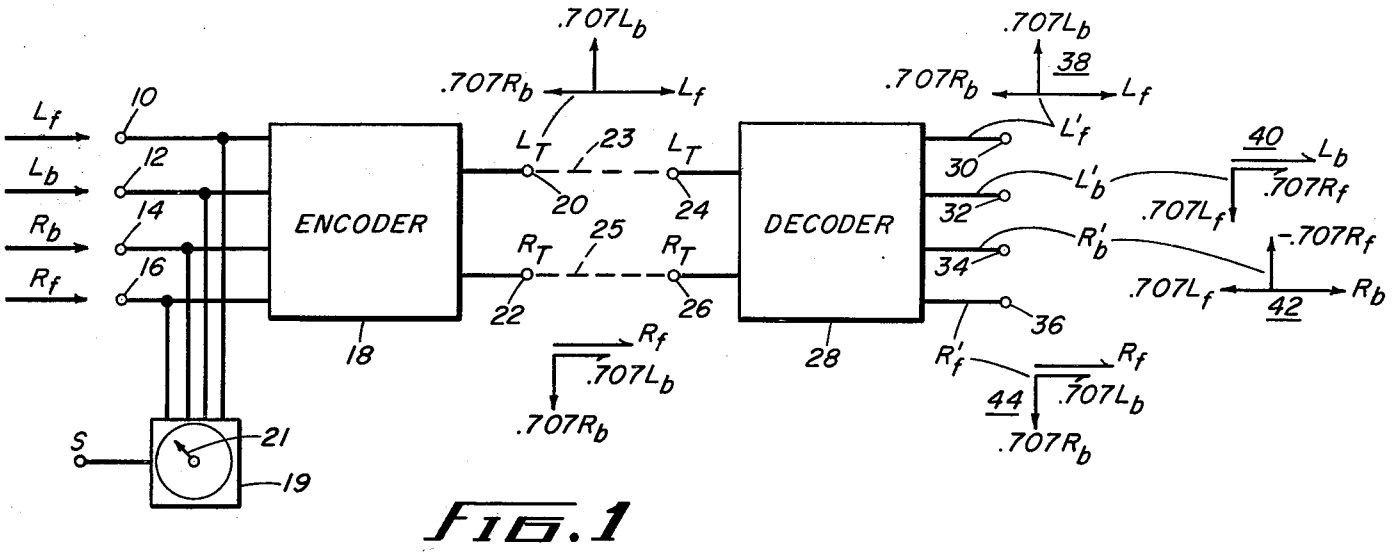
FIG. 1 is a block diagram of a quadraphonic system including an encoder and a decoder in which the present invention is applicable.

Referring now to FIG. 1, the quadraphonic sound recording and reproducing system in which the present invention finds utility, includes an encoder 18 having four input terminals 10, 12, 14 and 16 to which the input signals of a quadraphonic program, designated $L_f$, $L_b$, $R_b$ and $R_f$ (corresponding to left front, left back, right back and right front) are respectively applied. Additionally, a signal S may be applied to each of the input terminals by means of a panning potentiometer 19 having a control arm 21 adapted to be positioned to any selected azimuth angle. The output voltages of the panning potentiometer 19 are so proportioned that with the control arm positioned at an azimuth angle of 45°, the signal S is applied solely and fully to the right front terminal 16; for an azimuth angle of 135°, the signal S is applied solely and fully to the right back terminal 14; for an azimuth angle of 225°, the signal S is applied solely and fully to the left back terminal 12; and for an azimuth angle of 315°, the signal S is applied solely and fully to the left front terminal 10. For the 0° position of control arm 21, the signal S is applied equally to terminals 10 and 16 in such manner that $L_f = R_f = .707S$. Similarly, when the arm 21 is positioned at the 90°, 180°, and 270° azimuth angles, pairs of equal signals 0.707S, are applied to the terminal sets 14 and 16, 14 and 12, and 12 and 10, respectively. At other azimuth positions the proportions of the signal S applied to the respective adjacent terminals are such that one of them varies as the cosine and the other as the sine of the angle the arm makes relative to a reference terminal from which the angle is measured. It will be recognized that the total power fed to the encoder by the panning potentiometer remains constant regardless of the azimuth angle since the power fed into any one terminal varies as the square of the signal voltage, and the sum of cosine squared and sine squared is unity. The just-described panning control box is a piece of equipment conventionally used in recording studios where quadraphonic programs are produced.

The encoder 18 is described in detail in co-pending application Ser. No. 384,334, the disclosure of which is hereby incorporated by reference. Suffice it to say for an understanding of the present invention that the encoder is operative to matrix or encoder the four input signals to produce two composite signals designated $L_T$ and $R_T$ at output terminals 20 and 22 represented by the phasor groups adjacent terminals 20 and 22, respectively. These composite signals may be characterized in complex notation, as follows:

$$L_T = L_f - 0.707R_b + j.707L_b$$

and $$R_T = R_f + 0.707L_b - j.707R_b$$

That is, the $L_b$ components appearing in both composite signals are of substantially equal magnitude and in substantially quadrature relationship with each other, and in one composite signal is in leading relationship with the $L_b$ component in the other composite signal. Similarly, the $R_b$ signal components are substantially equal and in phase quadrature with each other in the two composite signals and in one is in lagging relationship with that in the other. In the interest of providing better realism of image placement when the record is played on a conventional stereophonic phonograph over two loudspeakers, it is preferable that the phasor $0.707L_b$ in the $R_T$ composite signal lag the similarly numbered phasor in the $L_T$ composite signal, and conversely, that the phasor $0.707P_b$ in the $L_T$ composite signal lag the corresponding phasor in the $L_T$ composite signal.

It is to be understood, however, that the configuration of signals characterized above may be altered without affecting the operating principles of the invention. For example, two composite signals characterized in complex notation, as follows:

$$L_T = L_f + 0.707R_b - j0.707L_b$$

and $$R_T = R_f - 0.707L_b + j0.707R_b$$

can be accommodated as well with the technique to be described herein. Another form of decoder for signals of the latter configuration is described in Bauer U.S. Pat. No. 3,794,781, assigned to the same assignee.

The encoded composite signals can be applied to any suitable two-channel medium represented by channels 23 and 25, which may be the two surfaces of the V-shaped groove in a stereophonic disc record, a two-channel tape, or an FM-multiplex radio channel.

Upon recovery from the two-channel medium, the composite signals are applied to the input terminals 24 and 26 of a decoder 28 of the type described in the just-mentioned co-pending applications. For purposes of understanding the present invention the decoder is operative to de-matrix the composite signals and to produce at output terminals 30, 32, 34 and 36 four output signals designated $L_f'$, $L_b'$, $R_b'$ and $R_f'$, respectively, characterized by the phasor groups 38, 40, 42 and 44, respectively. It will be noted from examination of the phasor groups that the signals $L_f$, $L_b$, $R_b$ and $R_f$ are predominant in phasor groups 38, 40, 42 and 44, respectively, and are proportionately equal in magnitude and phase relationship with the corresponding signals at input terminals 10, 12, 14 and 16 of the encoder. Additionally, however, each of the predominant signals is accompanied by side-effect signals originally applied to other input terminals of the encoder, these side-effect signals being characterized by the coefficients $\pm j0.707$.

As the signal S is panned over a 360° circle, the output signals $L_f'$, $L_b'$, $R_b'$ and $R_f'$ vary in magnitude and phase in a manner which can be computed from the respective cosine and sine inputs of the signal S to the respective input terminals 10, 12, 14 and 16. The results of such a calculation are tabulated in the following Table I and are plotted for graphic comparison in FIG. 2:

TABLE I

| Bearing Angle | Left Front Output | | | Left Back Output | | | Right Front Output | | | Right Back Output | | |
|---|---|---|---|---|---|---|---|---|---|---|---|---|
| 0 | .707 | at | 360° | .707 | at | 315.4° | .707 | at | 360° | .707 | at | 134.6° |
| 22.5 | .383 | — | 360 | .707 | — | 337.7 | .924 | — | 360 | .707 | — | 112 |
| 45 | .000 | — | 360 | .707 | — | 360 | 1.000 | — | 360 | .707 | — | 269.5 |

TABLE I-continued

| Bearing Angle | Left Front Output | | | Left Back Output | | | Right Front Output | | | Right Back Output | | |
|---|---|---|---|---|---|---|---|---|---|---|---|---|
| 67.5 | .271 | — | 180 | .653 | — | .0 | .963 | — | 343.8 | .757 | — | 59.2 |
| 90 | .500 | — | 180 | .500 | — | .0 | .866 | — | 325.1 | .866 | — | 35 |
| 112.5 | .653 | — | 180 | .271 | — | .0 | .757 | — | 301.1 | .962 | — | 16.3 |
| 135 | .707 | — | 180 | .001 | — | .0 | .707 | — | 270.9 | 1.000 | — | .1 |
| 157.5 | .707 | — | 157.1 | .383 | — | .00 | .707 | — | 293.3 | .923 | — | .0 |
| 180 | .707 | — | 134.4 | .707 | — | .0 | .707 | — | 315.6 | .706 | — | .0 |
| 202.5 | .707 | — | 111.7 | .924 | — | .0 | .707 | — | 337.8 | .381 | — | .0 |
| 225 | .707 | — | 89.1 | 1.000 | — | 360 | .707 | — | 360 | .001 | — | 180 |
| 247.5 | .757 | — | 58.9 | .962 | — | 343.8 | .653 | — | 360 | .272 | — | 179.9 |
| 270 | .866 | — | 34.8 | .866 | — | 325 | .500 | — | 360 | .501 | — | 179.9 |
| 292.5 | .963 | — | 16.1 | .757 | — | 300.8 | .271 | — | 360 | .654 | — | 179.9 |
| 315 | 1.000 | — | 360 | .707 | — | 270.6 | .000 | — | 360 | .707 | — | 180 |
| 337.5 | .924 | — | 360 | .707 | — | 293.1 | .383 | — | 360 | .707 | — | 157.3 |
| 360 | .707 | — | 360 | .707 | — | 315.4 | .707 | — | 360 | .707 | — | 134.6 |

FIG. 2 shows in columnar form the bearing of the applied signal in degrees, and the relative amplitudes and phase positions of the signal S for bearing increments of 22.5° as it appears at terminals 30, 32, 34 and 36 as the signals $L_f'$, $L_b'$, $R_b$ and $R_f'$.

It will be seen from examination of FIG. 2, that for azimuth angles greater than 315° and smaller than 45°, the phasors $L_f'$ and $R_f'$ are, in general, unequal but exactly in phase, whereas the phasors $L_b'$ and $R_b'$ are equal in magnitude but out-of-phase by amounts varying between 90° and 270°. For bearing angles greater than 135° and smaller than 225°, the phasors $L_b'$ and $R_b'$ are, in general, unequal but exactly in phase, whereas the phasors $L_f'$ and $R_f'$ are equal in magnitude but out-of-phase by amounts varying between 90° and 270°. An important feature of the present invention is the utilization of this out-of-phase condition in a logic circuit to produce a signal for controlling the cross-talk signals.

It will be further observed from FIG. 2 that for intermediate azimuth angles, namely, angles larger than 45° and smaller than 135°, the signals $L_f'$ and $L_b'$ are exactly 180° out-of-phase but, generally, of unequal amplitude, while the phasors $R_f'$ and $R_b'$ are generally both unequal and out-of-phase by angles greater than 0° and smaller than 90°. For angles greater than 225° and smaller than 315°, the phasors $R_f'$ and $P_b'$ are exactly 180° out-of-phase and of generally unequal magnitudes, while the phasors $L_f'$ and $L_b'$, in general, are unequal and out-of-phase by varying angles. These phasor relationships are also used in the logic, a first embodiment of which will now be described to illustrate the principle of operation.

Figure 3:
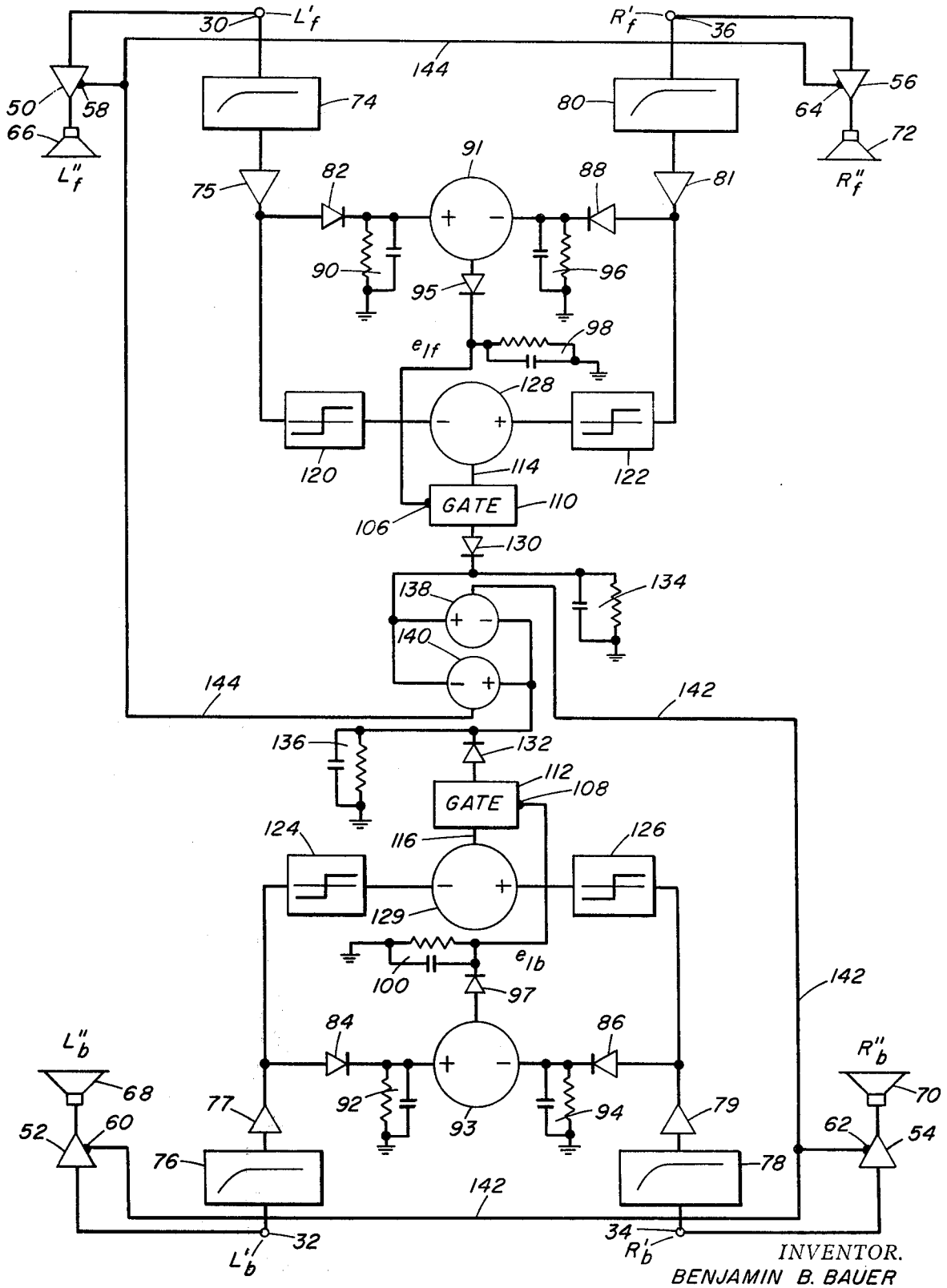
FIG. 3 is a schematic diagram of one form of logic circuitry embodying the invention.

Referring now to FIG. 3, the logic circuit is connected to the output terminals of the matrix decoder of FIG. 1, the terminals 30, 32, 34 and 36 thereof being repeated in the schematic diagram. These output terminals are connected to respective variable gain amplifiers 50, 52, 54 and 56, each having a control element 58, 60, 62 and 64, respectively. The output terminals of amplifiers 50, 52, 54 and 56 are connected to respective loudspeakers 66, 68, 70 and 72, shown in the positions at which they would be placed in a room or listening area for reproduction of left front, left back, right back and right front signals, respectively. The gain control amplifiers are so designed that in their neutral or quiescent condition of zero control voltage applied to their respective control electrodes, the gains of the amplifiers are maintained at approximately 70%, or about 3db down, from their maximum value, an increase in control voltage causes an increase in gain to a maximum of 100%, and application of a negative voltage produces diminution in gain and eventual cut-off of the amplifiers. The gain control element of each amplifier preferably also includes a time constant control element (not shown) which allows the gain to increase rapidly with application of a positive voltage, but causes it to diminish slowly when the positive voltage is removed or when a negative control voltage is applied.

The electronic logic of the invention, which is operative to generate control signals for the just-described gain control amplifiers, is connected to terminals 30, 32, 34 and 36, preferably through respective frequency-response shaping networks 74, 76, 78 and 80 having the response characteristic illustrated, which diminish or cut off frequencies below about 250 Hz in the applied signals. The output signals from the wave-shaping networks are applied through respective amplifiers (which may not be required in some situations) 75, 77, 79 and 81. Recalling the amplitude and phase relationships of the phasors appearing at the output terminals of the decoder as depicted in FIG. 2, it is the function of the logic to determine if the signals at the terminal pairs 30 and 36, and 32 and 34, are equal or unequal, and whether or not they are out-of-phase by an angle within the range between 90° and 270°. These decisions are made, for example, by first rectifying the two "front" signals by a pair of rectifiers 82 and 88 having RC time constant circuits 90 and 96, respectively, and rectifying the two "back" signals by rectifiers 84 and 86 having time constant circuits 92 and 94, respectively. These rectifiers are preferably full-wave rectifiers, and each has a time constant giving a rapid rise time, of the order of zero to a few milliseconds, and a relatively slow decay time, of the order of 50 to several hundred milliseconds. The outputs of rectifier 88 is subtracted from the output of rectifier 82 in a first combining junction 91. The output of rectifier 86 is subtracted from the output of rectifier 84 in a second combining junction 93. While not absolutely necessary, the difference signals produced by combining junctions 91 and 93 are rectified by rectifiers 95 and 97, respectively, having respective time constant circuits 98 and 100. The difference signals from junctions 91 and 93, designated $e_{1f}$ and $e_{1b}$, respectively, are applied to the control elements 106 and 108 of electronic switch or gate circuits 110 and 112, respectively. These gates are designed to allow the passage of electric current, in conductors 114 and 116, respectively, when their respective control voltages $e_{1f}$ and $e_{1b}$ are equal to zero, but to inhibit the flow of current when the control voltages differ from zero. Thus, if the signals at terminals 30 and 36 are of equal magnitude, the difference signal from combining junction 91 will be zero and the gate 110 will pass current in conductor 114, whereas if the signals are of different magnitude such current as may be present in conductor 114 can no longer flow through the gate. Similarly, if the signals at terminals 32 and 34 are of equal amplitude, switch 112 will allow the passage of current in conductor 116, whereas if they are of different amplitudes the gate will inhibit the flow of current therethrough.

The output signals from amplifiers 75 and 81 are also applied to respective clipping amplifiers 120 and 122; these are high gain amplifiers provided with diodes or other suitable voltage limiting or "clipping" devices to provide the illustrated transfer characteristic which allows the position of the axis-crossing of the applied signals to be clearly established, while at the same time, delivering an output signal having an amplitude essentially independent of the amplitude of the input signal. Similarly, the outputs of amplifiers 77 and 79 are applied to like respective clipping amplifiers 124 and 126. The output of amplifier 120 is subtracted from the output of amplifier 122 in a combining junction 128, and the output of amplifier 124 is subtracted from the output of amplifier 126 in a combining junction 129. If the signals at terminals 30 and 36 have equal frequency and phase positions, the difference signal appearing at the output 114 of junction 128 will be zero, and consequently the tendency of a current to flow in conductor 114 will also be zero. However, if the signals at terminals 30 and 36 are not in phase, a difference signal is produced in combining junction 128 tending to produce a current in conductor 114 which increases directly with the phase angle to a maximum value when the two signals are directly out-of-phase. Similarly, if the signals at terminals 32 and 34 have equal frequency and phase positions, the difference at the output of junction 129 will be zero, thus precluding the possibility of generating current in conductor 116. If the equal-frequency signals are not in phase, however, there will be a difference signal causing the current in conductor 116 to increase in proportion to the phase angle, reaching a maximum when the two signals are directly out-of-phase, as will be more clearly seen from the discussion to follow.

The output of gate 110 is rectified by a rectifier 130 (preferably full-wave) and preferably, but not necessarily, integrated with a leaky integrator consisting of the resistor-capacitor combination 134. The output of gate 112 is similarly rectified by a rectifier 132 and optionally smoothed or integrated with a leaky integrator 136. The voltages thus developed at the outputs of rectifiers 130 and 132 are subtracted in the combining junctions 138 and 140 in a mutually inverse relationship such that if the voltage at the output of rectifier 130 is greater than that at the output of rectifier 132 a positive output appears at the output 142 of junction 138 and a negative output appears at the output terminal 144 of the junction 140. Conversely, if the voltage delivered by rectifier 132 is greater than the voltage at the output of rectifier 130, a negative output appears on conductor 142 and a positive voltage appears on conductor 144. The voltage appearing on conductor 142 is applied in parallel to the gain control elements of the amplifiers 52 and 54 which amplify the back signals, and the signal on conductor 144 is applied in parallel to the gain control elements 68 and 64 of the gain control amplifiers feeding the front loudspeakers. Thus, the relative gains of amplifiers 50 and 56 will tend to move up when the voltage at the output of rectifier 130 exceeds the voltage at the output of rectifier 132, and at the same time the gains of amplifiers 52 and 54 are reduced. Conversely, the gains of amplifiers 52 and 54 are increased when the voltage at the output of rectifier 132 exceeds that of rectifier 130, and the gains of amplifiers 50 and 56 are diminished.

The action of the logic circuit will be better understood by again referring to FIG. 2, from which it is noted that with front originating sounds, that is, sounds identified with bearing angles between 315° and 45°, the voltages $L_f'$ and $R_f'$ are precisely in phase and generally have different magnitudes, while the voltages $L_b'$ and $R_b'$ are equal in magnitude, but vary in phase with respect to each other by 90° to 270°. It will be recalled from the description of the circuit of FIG. 3 that the voltages $L_f'$ and $R_f'$ appearing at terminals 30 and 36, respectively, after rectification and subtraction in the junction 91, produce a definite signal $e_{1f}$ at the output of the junction when they are of unequal magnitude. Thus, the gate 110 does not allow the current (if any) in conductor 114 to be conducted with the consequence that the voltage at the output of rectifier 130 is zero. On the other hand, the signals $L_b'$ and $R_b'$ appearing at terminals 32 and 34 are of equal magnitude whereby upon rectification by rectifiers 84 and 86, respectively, and subtraction in junction 93, the signal $e_{1b}$ produced at the output of the junction is zero. Thus, the gate 112 is turned on allowing the current (if any) in conductor 116 to be conducted. Whether there is a current in conductor 116 is determined by the relative magnitudes of the outputs of clipping amplifiers 124 and 126 resulting from clipping the signals $L_b'$ and $R_b'$ (after shaping and amplification) appearing at terminals 32 and 34, respectively. The signals $L_b'$ and $R_b'$ being 90° to 270° out-of-phase in the circumstances here under discussion, there will be a finite difference between the outputs of clipping amplifiers 124 and 126, which is maximum when the signals are 180° out-of-phase, which, it will be seen from FIG. 2, occurs when the azimuth angle is 0° (or 360°).

Figure 4:
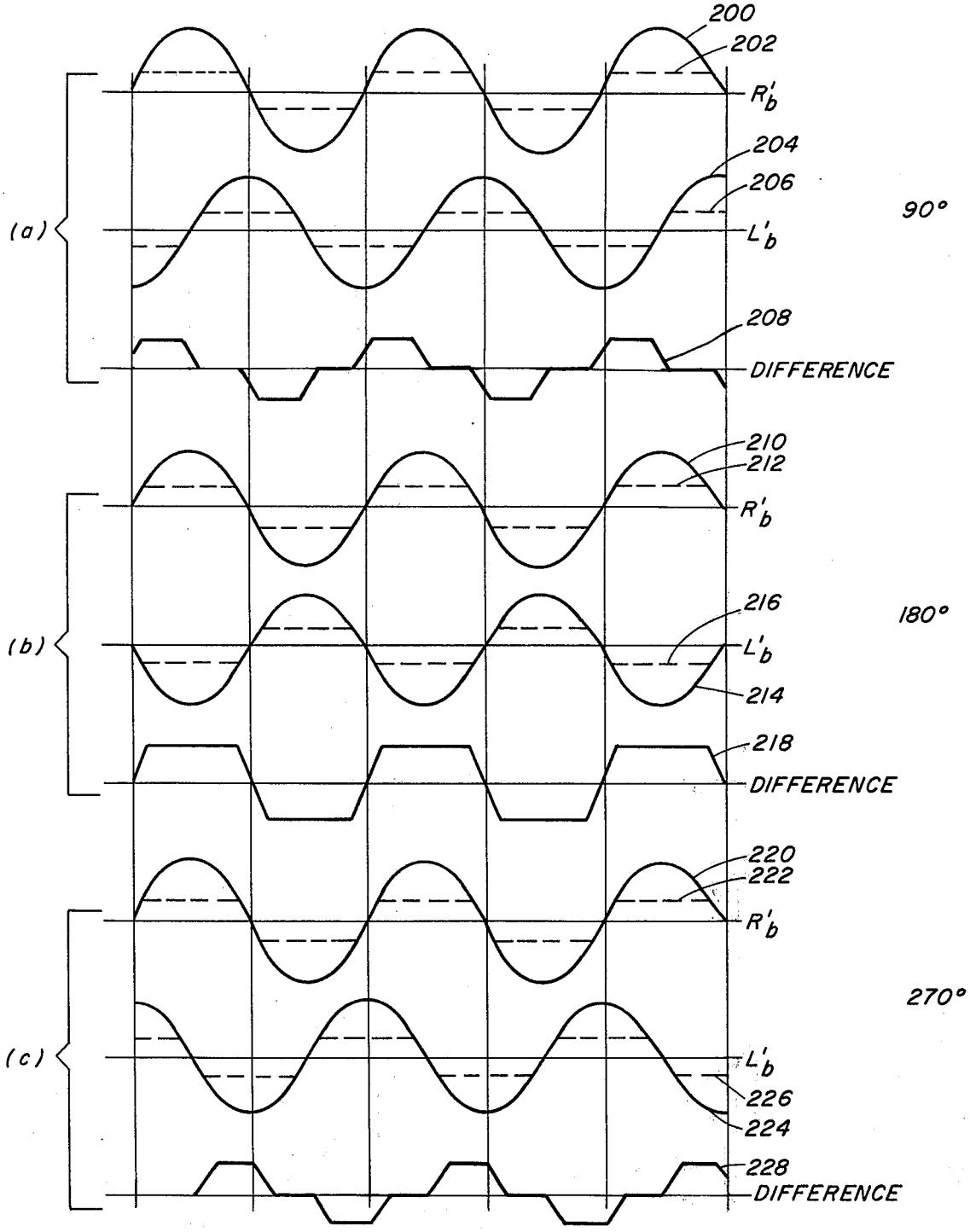
FIG. 4 is a series of waveforms useful in explaining the operation of the circuit of FIG. 3.

How the circuit is operative to produce this result will be more clearly seen from the waveforms illustrated in FIG. 4 for three different phase displacements between the $R_b'$ and $L_b'$ signals, namely, 90°, 100° and 270°, shown in groups (a), (b) and (c), respectively. The solid line 200 in group (a) depicts the voltage $R_b'$, and the dotted waveform 202 is the form taken by this voltage after being clipped by the clipping amplifier 126. The solid-line waveform 204 shows the voltage $L_b'$ 90° out-of-phase with respect to $R_b'$, and the dotted-line waveform 206 shows this voltage following clipping by clipping amplifier 124. Subtraction in junction 129 of the dotted-line waveform 206 from the dotted-line waveform 202 produces the difference voltage depicted by waveform 208.

In waveform group (b), in which the $R_b'$ voltage 210 is 180° out-of-phase relative to the $L_b'$ voltage 214, and which after clipping appear as dotted-line waveforms 212 and 216, respectively, a difference signal represented by waveform 218 is produced when signal 216 is subtracted in junction 129 from the clipped signal 212. Significantly, the peak value of waveform 218 is the same as that of waveform 208.

In group (c), the solid line waveforms 220 and 224 depict the $R_b'$ and $L_b'$ signals before clipping, and the dotted-line waveforms 222 and 226 respectively show these signals after clipping in their respective amplifiers 126 and 124. Subtraction of the clipped signal 226 from the clipped signal 222 produces the difference signal 228, which resembles the waveform 208 except that it is displaced in phase relative thereto. It will, of course, be recognized that the voltages represented by waveforms 208, 218 and 224 produce the difference signal current in conductor 116.

Recalling that for the situation under discussion the gate 112 is open, the current in conductor 116 flows through rectifier 132, charges the time constant network 136, and generates a voltage which is applied to the positive and negative terminals, respectively, of summing junctions 138 and 140. Also recalling that the output of rectifier 130 is zero for the signal conditions being considered, a positive signal is therefore produced on conductor 144 and a negative control signal appears on line 142. Thus, a positive control voltage is applied to the front gain control amplifiers 50 and 56, the parameters of the circuit being chosen such that their gains are increased by approximately 3db to bring them up to 100% gain, while at the same time the negative signal applied to the control elements 60 and 62 of the back gain control amplifiers 52 and 54 significantly reduces the gains or turns off the back amplifiers. This, of course, is the desired result inasmuch as it is the frontal signals that are desirably enhanced.

It will be noted that for one particular phase relationship between $L_f'$ and $R_f'$, namely, that which occurs when the azimuth angle is 0° (or 360°), their phasors are equal and in-phase. Consequently, the difference signal at the output of combining junction 91 is zero, thus causing gate 110 to open. However, since the signals are also in phase, after clipping they do not produce a difference signal at the output of junction 128; consequently, even with gate 110 open, there is no contribution to the control voltage appearing on conductors 142 and 144, and the conditions described in the preceding paragraph are unaltered.

Considering now the action of the logic for sound arrival or panning between 135° and 225°, examination of FIG. 2 will show that the situation is the reverse of that for azimuth angles between 315° and 45°. Now, the voltages $L_b'$ and $R_b'$ are generally unequal, but precisely in-phase and consequently their rectified difference appearing at the output of combining junction 93 produces a finite voltage $e_{1b}$ which inhibits the flow of any current therethrough (which in any event, however, would be zero because the signals are in-phase and subtraction after clipping by clipping amplifiers 124 and 126 would be zero). At the same time, signals $L_f'$ and $R_f'$ at terminals 30 and 36 are precisely equal and differ in phase by angles which range from 90° to 180° thereby resulting in a net signal output from gate 110. This organization of signals, then, produces a positive signal on conductor 142 which is operative to increase the gains of the back amplifiers 52 and 54 by approximately 3db, and a negative signal on conductor 144, which, when applied to the front amplifiers 50 and 56, reduces their amplification factors to zero or to a sufficiently low value as to effectively eliminate any side-effect signals from these amplifiers.

For bearing angles between 45° and 135°, and for bearing angles between 225° and 315°, it will be seen from FIG. 2 that none of the signals in either of the front or back pairs are of equal magnitude; consequently after rectification and differencing in junctions 91 and 93, finite signals $e_{1f}$ and $e_{1b}$ are both produced which close both of gates 110 and 112, thereby preventing the generation of control voltages by either of junctions 138 and 140, whereby all four amplifiers 50, 52, 54 and 56 remain in their quiescent or "3db down" normal gain condition for "side" sounds, namely, sounds arriving at angles between 45° and 135° and between 225° and 315°. The transition from the situation where one set of the front or back amplifiers is "on" and the other set is "off" and the quiescent condition need not be abrupt, and by proper design of the voltages at which the gates 110 and 112 are opened, a gradual transition may be obtained.

While it is seen from the foregoing description that the performance of the logic is theoretically independent of the amplitude of the signals being reproduced, it may be desirable for the reproduction of records having signals of large dynamic range to include compressor amplifiers 75, 77, 79 and 81 (previously mentioned but not discussed) for limiting the range of signal amplitude to a relatively marrow range to improve the reliability of the logic. It is to be understood, however, that the inclusion of these amplifiers is a refinement that does not alter the basic principle of operation of the logic.

Various modifications may be made to the system of FIG. 3 without departing from the spirit of the invention. For example, although ranges have been suggested for the various time constants used in the circuit (e.g., the time constants for gain control amplifiers 50, 52, 54 and 56) it is to be understood that values within wide limits can be used without affecting the basic operation of the logic, and will normally be selected to achieve acceptable and pleasing reproduction of the sound at the loudspeakers. Also, while not shown in FIG. 3, it may be desirable to provide a common gain adjustment to set the quiescent gain of gain control amplifiers 50, 52, 54 and 56 in order that their gains be the same when control signals do not appear on conductors 142 and 144.

Figure 5:
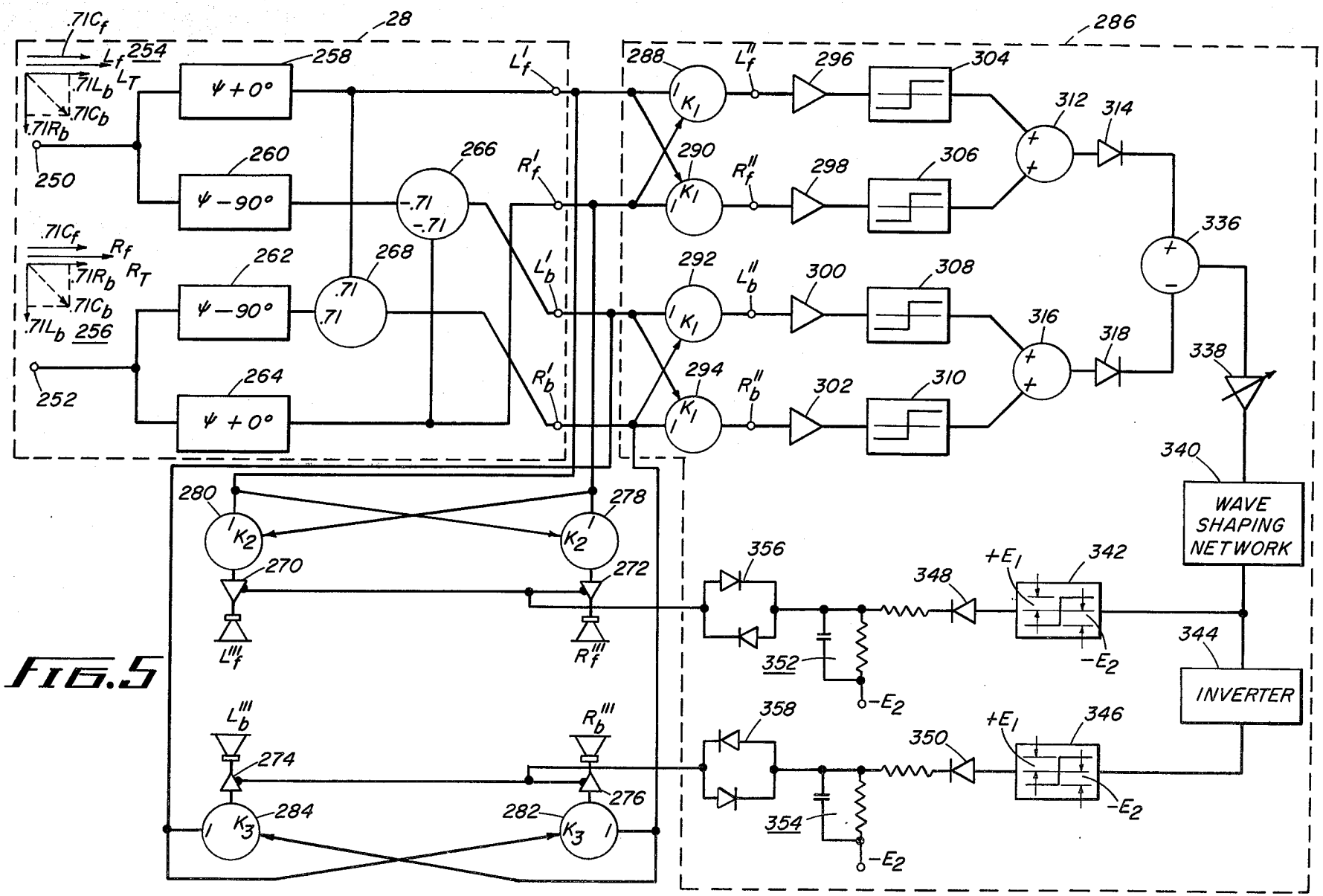
FIG. 5 is a schematic diagram of another form of logic circuitry embodying the invention.

Turning now to FIG. 5, there is illustrated another form of logic circuit utilizing the axis-crossing technique for developing control signals which is of simplier construction, and therefore easier and less expensive to implement in integrated circuit form, than the system of FIG. 3. Moreover, it resolves the operational ambiquity inherent in the system of FIG. 3 by eliminating dependence on the detection of equality of signals, i.e., on the production of a zero resultant, for the application of a control signal to the gain control amplifiers. This ambiquity is resolved by the circuit of FIG. 5 by "blending" the output signals from the matrix decoder in the logic and control circuit as taught in U.S. Pat. No. 3,798,373. Optionally, the output signals from the matrix decoder may also be blended before application to the loudspeaker circuits.

Figure 6B:
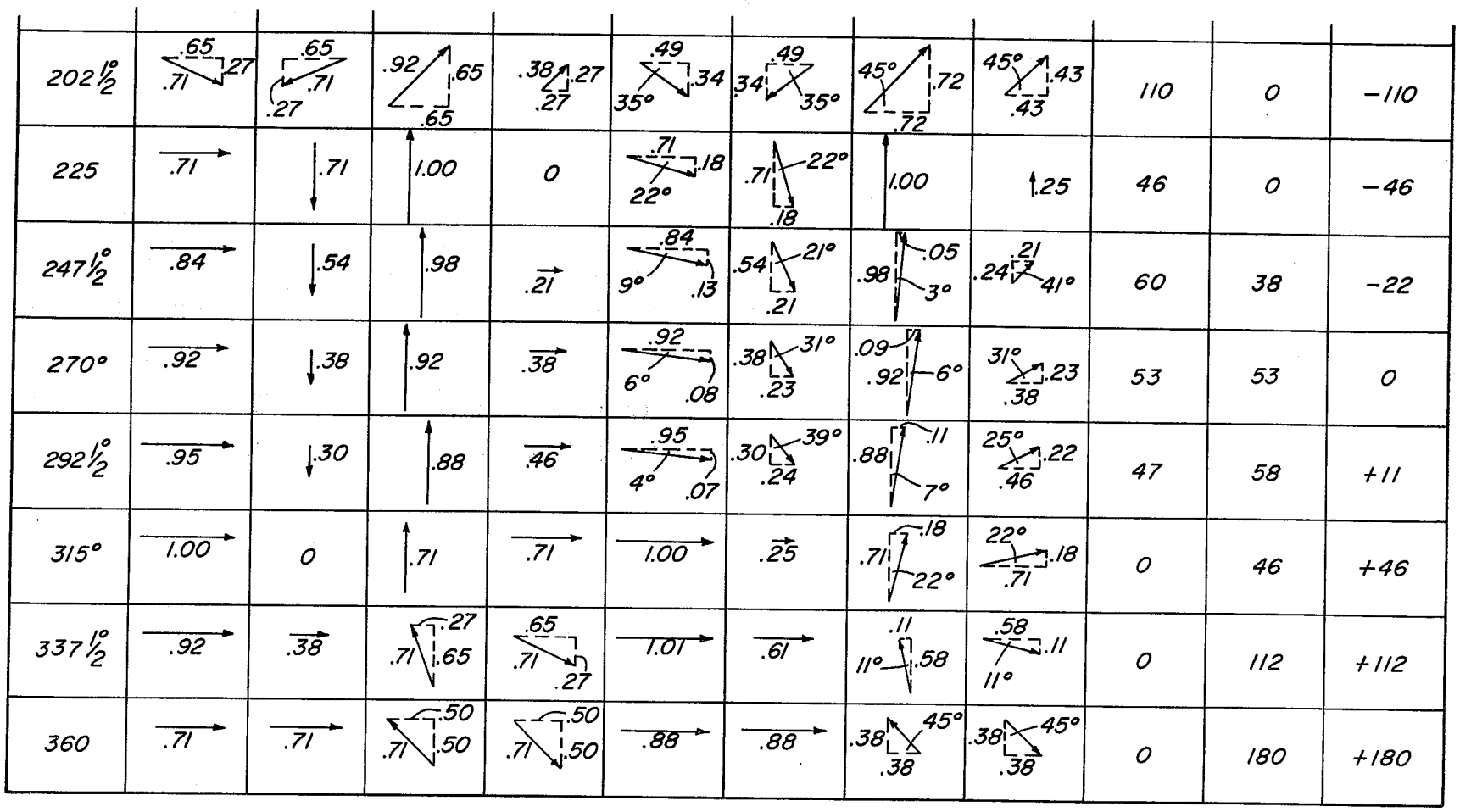
FIG. 6A and B is a table showing the magnitude and phase of signals appearing at various points in the circuit of FIG. 5 as a function of the bearing angle at which original signals are applied to the encoder.

The system of FIG. 5 will be described as it applies to the decoding of the composite signals $L_T$ and $R_T$ of the form depicted by the phasor diagrams 254 and 256, respectively. These composite signals respectively contain predominant component signals $L_f$ and $R_f$ and each contains component signals $0.71L_b$ and $0.71R_b$ with corresponding ones of these common signals in quadrature relationship in the two composite signals. Also shown in the phasor diagrams 254 and 256 are signals $0.71C_f$, which would result from a directional sound source originating from an azimuth of 0°, and signals $0.71C_b$, which would result from a directional sound source originating from an azimuth of 180°. Because the $C_b$ components are in phase in the two composite signals, and of equal amplitude, they present a possible decoding ambiguity which can be overcome by panning signals arriving from directions between $L_b$ and $R_b$ to achieve a more rapid transition of phases of such signals. The phasor diagrams 254 and 256 illustrate how ambiguities in decoding could arise for certain types of signals, but they do not fully depict all composite signals that can be produced by known encoders; rather, the latter are precisely specified in FIGS. 6A and 6B.

These composite signals are applied to respective input terminals 250 and 252 of a matrix decoder 28 containing four all-pass phase-shifting networks 258, 260, 262 and 264, each of which is operative to shift the phase of the signal applied to it by a fixed function of frequency, $\psi$, with the phase-shifting networks 260 and 262 introducing a phase-shift which differs from the reference angle by 90°. The composite signal $L_T$ is applied to both of networks 258 and 260, and the composite signal $R_T$ is applied to both of networks 262 and 264. The signals appearing at the output terminals of networks 258 and 264 correspond to composite signals $L_T$ and $R_T$ (except that they are shifted by the same reference angle $\psi$), and the output signals from networks 260 and 262 likewise have the same composition as their respective input signals except that they are shifted in phase by 90°. The output signals from networks 258 and 264, respectively containing $L_f$ and $R_f$ as their predominant components, constitute two of the output signals from the decoder and appear at terminals designated $L_f'$ and $R_f'$, respectively. The output signal from network 260 is multiplied by −0.71 and combined in a combining circuit 266 with −0.71 of the signal from network 264 to produce at terminal $L_b'$ a composite output signal containing $L_b$ as its predominant component. Similarly, 0.71 of the signal from network 258 is combined with 0.71 of the signal transmitted by network 262 to produce a fourth composite output signal at terminal $R_b'$ in which $R_b$ is predominant.

The output signals appearing at terminals $L_f'$, $R_f'$, $L_b'$ and $R_b'$ of the matrix decoder are respectively applied to four loudspeakers designated $L_f'''$, $R_f'''$, $L_b'''$ and $R_b'''$, preferably positioned at the left front, right front, left back and right back corners of a listening area, respectively, and for purposes of enhancing the gain or transmission of a particular original signal, the loudspeaker circuits respectively include gain control amplifiers 270, 272, 274 and 276. In accordance with the teaching of U.S. Pat. No. 3,798,373, channel separation may be improved by adding a portion of the "left front" signal to the "right front" signal in summing junction 278, and adding a portion of the right front signal to the left front signal in summing junction 280. Similarly, a fraction of the "left back" is added to the "right back" signal in summing junction 282 and a portion of the right back signal is added to the left back signal in junction 284. The factor $k_2$ appearing on summing junctions 278 and 280, and the factor $k_3$ appearing on summing junctions 282 and 284 signifies that the "blend" may be different for the front channels than for the back channels, and while the blend percentage is usually higher in the back channels, this is not essential and the values of $k_2$ and $k_3$ may vary over wide limits.

The gain of the gain control amplifiers 270, 272, 274 and 276 is adjusted by the logic and control circuit 286 to emphasize the transient or strongest signal instantaneously present to improve the realism of the quadraphonic presentation. The control signals for the gain-control amplifiers are developed from the output signals from the matrix decoder 28, and to eliminate the above-mentioned ambiguity, a portion, $k_1$, of the signal appearing at terminal $R_f'$ is mixed or blended in summing junction 288 with the signal appearing at terminal $L_f'$, and a like portion of the signal at terminal $L_f'$ is mixed in summing junction 290 with the signal at terminal $R_f'$. Similarly, portions of the back channel signals are mixed or blended with each other in summing junctions 292 and 294. The value of the fraction $k_1$ may vary within wide limits without affecting the operation of the control circuit, and in the example to be discussed in detail below, is assumed to have a value of 0.25. It will be appreciated that the blending action produces four new composite signals each of which contains a predominant component appropriate to the respective loudspeakers and some fraction of the other three of the original encoded signals to the extent they are instantaneously present.

The nature of these signals, on which the operation of the logic circuit is based, will now be analyzed with reference to the table of FIG. 6 in which there is listed in Column I the numerical values of the azimuth of sound arrival, at 22½° intervals, and Columns II and III depict in phasor representation the values of the input voltages $L_T$ and $R_T$ applied to terminals 250 and 252 of the matrix decoder. It will be seen that in most of the situations tabulated in Columns II and III the phasor arrows are either horizontal or vertical; in those cases where they are at an angle relative to the horizontal or vertical, the angular position is expressed by the values of its horizontal and vertical projections.

It will be observed that Columns II and III each have two headings: $L_T$ and $L_f'$ and $R_T$ and $R_f'$, respectively; the reason for this is that $L_f'$ differs from $L_T$ only in being shifted in phase by the reference angle $\psi$, and $R_f'$ likewise differs from $R_T$ only by the phase shift $\psi$. Therefore, the relative phase relationship between $L_f'$ and $R_f'$ is identical to that between $L_T$ and $R_T$, and if the fixed function $\psi$ between the two headings of Columns II and III is kept in mind, no confusion is created by this usage.

Columns IV and V give the values for $L_b'$ and $R_b'$. It will be recalled that $L_b'$ is obtained by shifting $L_T$ by 90° lagging with respect to $R_T$, multiplying both of these by 0.71 and adding the two products together in a negative sense; the phasors in Column IV reflect this operation. Similarly, the action of the matrix decoder of shifting $R_T$ by 90° lagging with respect to $L_T$, multiplying the two by 0.71 and adding the products to obtain $R_b'$, is reflected in Column IV.

Columns VI, VII, VIII and IX tabulate the values for the signals $L_f''$, $R_f''$, $L_b''$ and $R_b''$, respectively, these being the signals appearing at the output terminals of blend junctions 288, 290, 292 and 294. With the assumed value of $k_1$ of 0.25, the signal $L_f''$ is obtained by adding 25% of $R_f'$ to $L_f'$, and $R_f''$ is obtained by adding 25% of $L_f'$ to $R_f'$. Similarly, $L_b''$ is obtained by adding 25% of $R_b'$ to $L_b'$, and $R_b''$ is obtained by adding 25% of $L_b'$ to $R_b'$.

It will be seen from examination of the phasors representing the $L_f''$ and $R_f''$ pair (columns VI and VII) and the $L_b''$ and $R_b''$ pair (columns VIII and IX) that for azimuthal angles between 315° and 45° the phasors of the first pair are in phase, while the corresponding phasors of the other pair are out of phase by varying angles. On the other hand, for azimuthal angles between 135° and 225°, the phasors of the $L_b'' - R_b''$ pair are the ones that are in phase, while those of the first pair are out of phase by varying angles. The phase angle difference between the phasors of the front pair is tabulated as ΔF° in Column X, and the angle between the phasors of the back pair is presented in Column XI as ΔB°. This tabulation clearly shows that for azimuthal angles between 315° and 45°, ΔF has a value of zero and that as the azimuth angle increases from 45° the value of ΔF increases until for 180° azimuth the phasors are in phase opposition, that is, 180° out of phase, then diminishes with further increase in the azimuth angle, returning again to zero at 315°. The value of ΔB, on the other hand, diminishes from 180° at 0° azimuth down to zero at 135° and remains at this value until the azimuth angle of 225° is reached and then increases with azimuth angle until it again is 180° for an azimuth of 360°. The operation of the improved control circuit of FIG. 5 is based upon this observation.

Reverting now to FIG. 5, the signals $L_f''$, $R_f''$, $L_b''$ and $R_b''$ are amplified (if necessary) in respective amplifiers 296, 298, 300 and 302 to bring them to a suitable voltage level for operation thereon by the control signal generating circuit. These amplifiers may be provided with frequency-response modifying networks and suitable filters to suppress undesired frequencies and to enhance signals of desired frequencies. The amplified signals are then clipped in respective clipping amplifiers 304, 306, 308 and 310, having the indicated transfer characteristics, to convert the signals into rectangular waveform signals having fast rise and fall times. The output signals from clipping amplifiers 304 and 306 are summed in a summing junction 312 and the output signals therefrom rectified by a rectifier 314, which is preferably a full-wave rectifier. Similarly, the output signals from clipping amplifiers 308 and 310 are summed in a summing junction 316 and the resulting signal rectified by rectifier 318, again preferably a full-wave rectifier. It will be seen from the description to follow that the output signals from rectifiers 314 and 318 are proportional to the phase angles between the signal pairs $L_f''$ and $R_f''$ and $L_b''$ and $R_b''$, respectively, having a maximum value when the signals in the pairs are in phase and having a value of zero when the signals in the pairs are in phase opposition.

Figure 7:
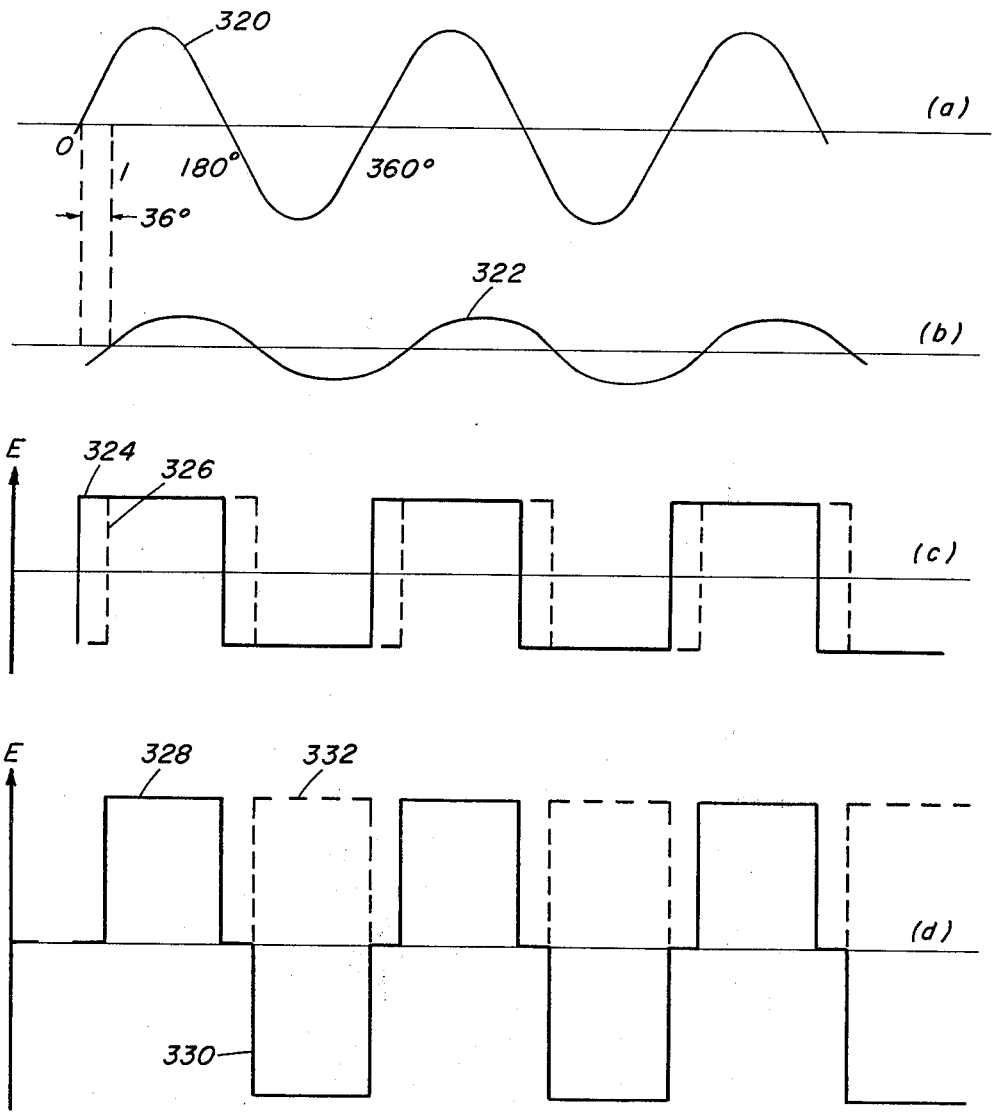
FIG. 7 is a series of waveforms useful in explaining the operation of the system of FIG. 5.

How these signals are utilized to develop control signals will be understood from consideration of FIG. 7, in which it is assumed that the sine wave labeled (a) represents the signal $L_f''$ and that the sine wave (b) represents the signal $R_b''$, with the latter lagging the former by some angle, an angle of 36° having been selected by way of example. Waveform (c) illustrates the nature of the waveforms that result if the sine waves (a) and (b) are subjected to hard-limiting. More specifically, the solid-line rectangular waveform 324 would result from hard-limiting sine wave 320; it will be noted that it goes positive when sine wave 320 crosses the zero-axis in the positive-going direction and goes negative when the sine wave 320 crosses the zero-axis in the negative-going direction. Similarly, the dotted-line rectangular waveform 326 represents the result of hard-limiting sine wave 322 and likewise goes positive as the sine wave crosses the zero-axis in the positive-going direction and goes sharply negative as the sine wave crosses the zero-axis in the negative-going direction. The two rectangular waveforms are of equal amplitude, in spite of the differences in amplitude of the input sine waves, but are displaced by an interval corresponding to the phase angle between the original sine waves. It will be appreciated that if there were no displacement the sum of the two rectangular waves 324 and 326 would simply be a rectangular wave of twice the indicated height, positive and negative during successive half cycles. However, because they are displaced by the indicated interval, when the two waveforms are added, a signal having the waveform shown in FIG. 5(d) results; it is seen that it has twice the amplitude of the individual summed signals but each of the half-cycles is of shorter duration. If now the solid-line waveform (d) is full-wave rectified, the entire wave appears above the axis; consisting of the successive solid-line and dotted-line cycles 328, 332, etc. It will be appreciated that the area under this waveform is less by the fraction (180 −36)/180 of what it would be if there were no displacement between the waves. It is this characteristic of the result of full-wave rectifying the sum of two hard-limited sinusoidal signals that is utilized in the system of FIG. 5 to measure the phase angle between the phasors representing the front pair, i.e., $L_f''$ and $R_f''$, and between the signals of the back pair, namely, $L_b''$ and $R_b''$, and to develop a control signal in response thereto.

Applying the immediately preceding discussion to the system of FIG. 5, the limiting amplifiers 304 and 306 followed by the summing junction 312 and the full-wave rectifier 314 constitutes a time-interval or phase-measuring system capable of recognizing the degree to which the two applied signals are out of phase because the area under each cycle of the wave varies from a maximum value when the applied signals are in phase to a value of zero if the waves are in phase opposition. This area varies linearly with the phase angle, thereby providing a sensitive means for ascertaining the phase-angle between the two waves. Thus, the signal delivered by rectifier 314 is proportional to ΔF° and the signal delivered by rectifier 318 is linearly proportional to ΔB°. It will be evident that if the signal from rectifier 318 is subtracted from the signal from rectifier 314, as in a subtracting junction 336, the resulting signal is proportional to the net difference between ΔF and ΔB, and as will be seen from the discussion to follow, may be utilized as a control signal for the gain control amplifiers in the loudspeaker circuits.

Reverting again to the table of FIG. 6, it will be noted that for an azimuth of 0°, ΔF has a value of 0° whereas ΔB has a value of 180°; thus, for this condition the output signal from rectifier 314 is maximum and the output signal from rectifier 318 is zero, with the consequence that when the latter is subtracted from the former the resulting difference signal is of maximum amplitude in the positive direction. This maximum signal, then, is proportional to the difference between 0° and 180°, or 180°, as indicated in Column XII. As the azimuth angle of the applied directional signal increases, the value of Δ decreases in value, becoming zero at 90° azimuth (corresponding to a center right signal) and then increases to a negative maximum at an azimuth of 180° (center back), decreases again to zero at 270° (center left), and increases to a positive maximum for center front signals (360°). It should now be evident that a control signal corresponding proportionally to the angle Δ can be utilized to control the gains of gain control amplifiers 270, 272, 274, and 276 in such a manner that when there is an encoded directional signal corresponding to the front half of the field, that is, from azimuth angles greater than 270° and less than 90°, the front amplifiers 270 and 272 will have a proportionally higher gain than the back amplifiers 274 and 276, thus favoring reproduction by the front loudspeakers. On the other hand, for azimuth angles greater than 90° and less than 270° the situation will be reversed and the back part of the field will be favored over the front half. It is to be understood that the interplay of sounds corresponding to the front and back fields results in successive display of these sounds from the four loudspeakers to produce a realistic reproduction of sounds from all directions.

It will have been noted that for azimuth angles of 90° (center right) and 270° (center left) the control signal goes to zero; however, examination of the phasors of the signals $L_f'$, $R_f'$, $L_b'$ and $P_b'$ for signals from these directions reveals that they differ in amplitude from left to right and vice versa by a factor 0.92/0.38 = 2.42, which corresponds to 7.7db, a reasonably good separation, taking into account the fact that side signals usually are not of significant importance in the reproduction of serious music in that they consist mainly of reverberant sounds.

Referring again to FIG. 5, the control signal from junction 336, which may be positive or negative depending upon the value of Δ, is amplified to a suitable level by an amplifier 338, which may have adjustable gain as indicated. After amplification, the control signal is preferably applied to a wave-shaping network having a predetermined frequency response characteristic. It has been found that the control function is best performed by utilizing signals contained in the combined composite signals $L_f''$, $R_f''$, $L_b''$ and $R_b''$ of frequencies above approximately 250 Hz, and by emphasizing frequencies to which the human ear is very sensitive, say 3,000 Hz. Networks having these characteristics are well known in the art. In addition to this frequency response-modifying network, the amplifier 338 should have a good low-frequency transmission, down to DC, and a relatively rapid high-frequency cutoff above about 400 Hz. to insure that the resulting control signal varies at a relatively low rate, say, equivalent to about 300–400 Hz. rate, but devoid of high frequency variations. With these precautions, relatively rapid attack times of approximately 2–3 milliseconds can be obtained without erratic operation, which would otherwise result if the control signal were to vary at a high audio-frequency rate. It is to be understood, however, that the just-described parameters are by way of example, and that the frequency limits for the control signal may vary within reasonable limits without departing from the spirit of the invention.

Figure 8:
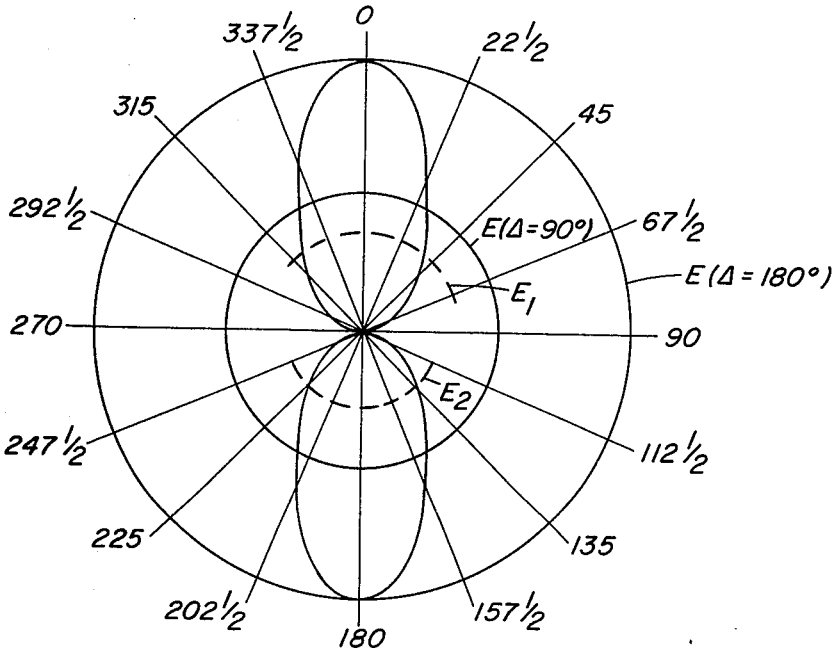
FIG. 8 is a curve illustrating the control characteristic of the logic circuitry of FIG. 5.

The control signal derived from amplifier 338 and wave-shaping network 340 is proportional, as a function of azimuth, according to the values of Δ listed in Column XII of FIG. 6. This proportionality is plotted in FIG. 8, in which the solid line curve shows the amplitude of the control signal as a function of the angle of incidence of the directional signal originally applied to the encoder; it will be noted that the amplitude of the control signal is different for different angles of arrival. It being desirable, in general, that the amplitude of the control signal be substantially constant for all signals in the "front field" (i.e., between 315° and 45° azimuth) and for all signals in the "back field" (i.e., between 135° and 225°) the amplitude of the control signal is preferably limited to have a predetermined relatively constant level within these angular fields. This is accomplished by applying the signal from amplifier 338 to a limiting amplifier 342 and also, after inversion in an inverter 344, to a second limiting amplifier 346. The illustrated transfer characteristic of the limiting amplifiers has a negative control voltage of $-E_2$ and a positive control voltage of $+E_1$. The output signals from the limiting amplifiers 342 and 346 are rectified, preferably full-wave, by rectifiers 348 and 350, respectively, and the resulting signals are applied to respective like time constant circuits 352 and 354. The values of the resistors and of the capacitor in the time constant circuits are selected to provide attack times of the order of two to three milliseconds and decay times of the order of 30 to 70 milliseconds, the exact times, which may vary within wide limits, being selected to give best performance, usually subjectively determined. The time constant circuits 352 and 354 are each returned to a reference potential $-E_2$, which corresponds to the negative control voltages of limiting amplifiers 342 and 346, to insure the desired smooth form for the decay function of the time constant circuits.

It will be evident from the description thus far that for positive values of Δ the signal from junction 336 is of positive polarity; thus, in this case the signal from limiting amplifier 342 is also positive, and the signal from amplifier 346, because of the action of inverter 344, is negative. The maximum amplitude of such positive signal from limiting amplifier 342 is $E_1$ and the maximum amplitude of the negative-going signal from limiting amplifier 346 is $-E_2$; the effect of this limiting or clipping action is indicated by the circles labeled $E_1$ and $E_2$ in FIG. 8. If, on the other hand, Δ has a negative value, indicating the presence of predominant back signals, the signal from junction 336 would be negative, as it would be at the output of amplifier 342, but because of inversion by inverter 344, the signal from limiting amplifier 346 would be positive and limited in amplitude to the level $E_1$. Thus, in both cases, a positive signal is derived for controlling the gain or transmission characteristic of the appropriate gain control amplifiers in the loudspeaker circuits. The control signal from limiting amplifier 342 is applied to the gain control electrode of both of gain control amplifiers 270 and 272, which respectively control the amplitude of signals applied to the left front and right front loudspeakers, and the control signal developed by amplifier 346 and its associated time constant circuit is applied to the gain control electrode of both of gain control amplifiers 274 and 276, which respectively control the signals applied to the left back and right back loudspeakers.

Figure 9:
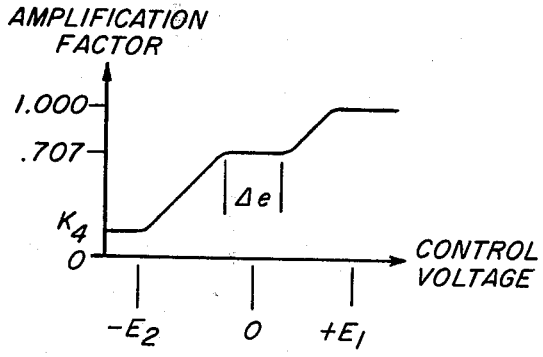
FIG. 9 is a plot of the amplitude of the control signal developed by the logic circuitry of FIG. 5 as a function of the bearing angle at which original signals are applied to the encoder.

The gain control amplifiers 270, 272, 274 and 276 have the gain control characteristic illustrated in FIG. 9 which, it will be seen, varies generally linearly from an amplification factor below cutoff for a control voltage of $-E_2$ to an amplification factor of unity for a value of control voltage equal to $+E_1$. This generally linear characteristic may be modified to provide a "shelf" of width of $\Delta e$ which straddles the quiescent or "0" volt point of the control signal. By thus modifying the control characteristic, unless there is a definite front or back signal present all four gain control amplifiers have a relative amplification factor of 0.707, thereby to cause equal transmission by all amplifiers and proper reproduction of side signals. The "shelf" in the control characteristic may be provided by "slicers" 356 and 358, each consisting of a pair of oppositely poled diodes connected in parallel, connected in the circuit paths between limiting amplifiers 342 and 346 and their respective gain control amplifiers. The sensitivity of the control function may be adjusted by varying the gain of amplifier 338; this would tend to change the slope of the control characteristic of FIG. 9 without changing the maximum or minimum amplification factors. The latter may be varied by adjusting the limiting control voltages $E_1$ and $E_2$ in the limiting amplifiers 342 and 346.

Although the system of FIG. 5 represents a preferred embodiment, there are other ways of implementing individual functions of the system, it being the intention that such modifications are within the scope and spirit of the invention. For example, means other than the limiting amplifiers 304, 306, 308 and 310 may be employed to convert the signals from the matrix decoder into rectangular waves. Any means capable of sensing when the composite signal crosses the zero-axis in the positive or negative direction and in response thereto triggering an electronic switch into a positive or a negative condition, respectively, would be satisfactory for the purpose. Indeed, such a system would disregard the amplitude of the input wave and would sense only its zero-axis crossings; the relationships between the axis crossings gives the desired information about the relative phase relationships of the applied signals regardless of their amplitudes. Also, correlation detectors may be used instead of summing junctions 312 and 316 to develop signals proportional to phase displacement. In a correlation detector, the output signals from limiting amplifiers 304–310 would be multiplied and integrated to provide a very sensitive determination of the phase relationship of multi-frequency signals.

Further, instead of preceding the rectifiers 348 and 350, the limiting amplifiers 342 and 346 may be installed between the time constant circuits 352 and the slicers 356 and 358. By thus connecting the limiting amplifiers, a longer time constant is obtained for center front or center back sounds, that is, sounds arriving at azimuth angles of 0° and 180°, than in the case of sounds arriving from azimuth angles of 45°, 135°, 225° and 315°, thereby to enhance the effectiveness of front-to-back channel separation.

I claim:

1. Decoder apparatus for translating first and second composite signals $L_T$ and $R_T$ respectively containing, when present, dominant left front ($L_f$) and right front ($R_f$) signal components each including left back ($L_b$) and right back ($R_b$) signal components, when present, and wherein said $L_b$ signal components have substantially equal magnitude and are in substantially quadrature relationship with each other in said first and second composite signals and in one is in leading relationship with that in the other and wherein said $R_b$ signal components have substantially equal magnitude and are in substantially quadrature relationship with each other in said first and second composite signals and in one of said composite signals is in lagging relationship with that in the other, into four separate output signals respectively predominantly containing, when present, $L_f$, $R_f$, $L_b$ and $R_b$ signals, said apparatus comprising, in combination:

a decoding matrix having first and second input terminals to which said $L_T$ and $R_T$ composite signals are respectively applied, and first, second, third and fourth output terminals, said matrix being operative to transfer substantially equal amounts of said $L_f$, $R_f$, $L_b$ and $R_b$ signal components, when present, as dominant signals to said first, second, third and fourth output terminals, respectively said $L_f$ and said $R_f$ signals each being accompanied by lower amplitude, quadrature-related $L_b$ and $R_b$ signal components with the $L_b$ and the $R_b$ components accompanying the $L_f$ and $R_f$ signals also being in quadrature with each other, and said $L_b$ and the $R_b$ signals each being accompanied by lower amplitude, quadrature-related $L_f$ and $R_f$ signal components with the $L_f$ and $R_f$ signal components accompanying the $L_b$ signal being in phase opposition to the $R_f$ and $L_f$ signal components accompanying the $R_b$ signal;

first, second, third and fourth gain control amplifiers respectively connected to said first, second, third and fourth output terminals and each having input and output terminals and a control electrode, said gain control amplifiers each having a gain characteristic which varies with the control voltage applied to its control electrode and being normally operative at a first quiescent control voltage level which produces a first amplification factor lower than its full amplification by a selected amount, and having a time constant to cause it to respond relatively less rapidly to application of a negative-going control voltage, control circuit means connected to the output terminals of said decoding matrix and operative to compare the relative amplitudes and phase positions of the signals instantaneously present at said first, second, third and fourth output terminals and to produce a first control signal when the output signals at the third and fourth output terminals of the decoding matrix are of equal amplitude and out of phase or a second control signal when the output signals at the first and second output terminals of the decoding matrix are of equal amplitude and are out of phase, or both said first and second control signals, means for applying said first control signal, if present, to the control electrodes of said first and second gain control amplifiers, and means for applying said second control signal, if present, to the control electrodes of said third and fourth gain control amplifiers.

2. Apparatus in accordance with claim 1 wherein said control circuit means includes first and second combining junctions each having first and second input terminals and an output terminal, said first and second control signals, if present, appearing at the output terminal of said first and of said second combining junction, respectively, and first and second like signal-comparing networks respectively connected between the first and second output terminals of said decoding matrix and the first input terminal of both said summing junctions, and between the third and fourth output terminals of said decoding matrix and the second input terminal of both said summing junctions, said first and second networks each being operative to compare the relative amplitudes and phase positions of the signals present at the pair of decoding matrix output terminals to which they are respectively connected.

3. Apparatus in accordance with claim 2 wherein each of said signal-comparing networks includes circuit means for comparing the amplitudes of the two signals applied thereto and operative to produce an output signal only in response to a difference in amplitude between said two signals, circuit means for comparing the phase between the two signals applied thereto and operative to produce an output signal which increases from zero when the two signals are in phase to a maximum value when the two signals are 180° out-of-phase, and a gate circuit operative in response to no output signal from said amplitude-comparing means to transfer an output signal, if present, from said phase-comparing means to corresponding input terminals of said first and second combining junctions.

4. Apparatus in accordance with claim 3 wherein said signal amplitude-comparing means includes means for separately rectifying said two signals, and a third signal combining junction operative to produce an output signal proportional to the difference in amplitude of the rectified signals.

5. Apparatus in accordance with claim 3 wherein said phase-comparing means includes a pair of clipping circuits to which said two signals are respectively applied, and a fourth signal combining junction to input terminals of which the output signals from said clipping circuits are applied and being operative to produce an output signal proportional to the phase displacement between said two signals.

6. Apparatus in accordance with claim 4 further including means for rectifying the output signal from said third signal combining junction and applying the rectified output signal to said gate circuit.

7. Apparatus in accordance with claim 6, further including means for rectifying the signal, if any, transferred by said gate circuit, and means for applying the rectified transferred signal to said first and second combining junctions.

8. Apparatus in accordance with claim 3 further including first and second wave-shaping networks through which said two signals are respectively applied to said amplitude-comparing means and said phase-comparing means.

9. Signal decoding apparatus comprising in combination:

a decoder matrix for translating first and second composite signals respectively containing left front ($L_f$) and right front ($R_f$) signal components and each including quadrature-related left back ($L_b$) and right back ($R_b$) signal components, into first, second, third and fourth separate output signals respectively predominantly containing the $L_f$, $R_f$, $L_b$ and $R_b$ signal components, the dominant $L_f$ and $R_f$ signal components at the output of the decoder matrix each being accompanied by lower-amplitude quadrature-related $L_b$ and $R_b$ signal components and the dominant $L_b$ and $R_b$ signal components each being accompanied by lower-amplitude quadrature-related $L_f$ and $R_f$ signal components with the $L_f$ signal component accompanying the $L_b$ and $R_b$ signals being in phase opposition to the $R_f$ signal component accompanying the $L_b$ and $R_b$ signals;

first, second, third and fourth gain-control amplifiers respectively connected to receive the said first, second, third and fourth output signals from said decoder matrix and each having a gain control terminal; and a control circuit connected to the output terminals of the decoder matrix and operative to compare the phase positions of the signals instantaneously present at the said output terminals to produce a first control signal when said third and fourth output signals are out-of-phase or a second control signal when said first and second output signals are out-of-phase, or both said first and second control signals, said control circuit being connected to apply the first control signal, if present, to the gain-control terminals of the first and second gain-control amplifiers for increasing the magnitudes of the first and second output signals relative to the magnitudes of the third and fourth output signals and to apply the second control signal, if present, to the gain-control terminals of the third and fourth gain-control amplifiers for increasing the magnitudes of the third and fourth output signals relative to the magnitudes of the first and second output signals.

10. Signal decoding apparatus in accordance with claim 9, wherein said control circuit includes a first signal-generating means responsive to a difference in phase between the $L_b$ and $R_b$ signals and to substantial equality of these signals to generate a first intermediate signal, a second signal-generating means responsive to a difference in phase of the $L_f$ and $R_f$ signals and to substantial equality of these signals to generate a second intermediate signal, and means responsive to the difference of the said first and second intermediate signals to generate the first and second control signals.

11. Apparatus in accordance with claim 10, wherein the control circuit further includes means for comparing the relative amplitudes of the signals instantaneously present at the said output terminals and is operative to increase the gain of the first and second gain-control amplifiers when the output signals at the third and fourth output terminals of the decoder matrix are equal and out of phase, and to increase the gain of the third and fourth gain-control amplifiers when the output signals at the first and second output terminals of the decoder matrix are equal and out of phase.

12. Apparatus in accordance with claim 9 wherein each gain-control amplifier responds more rapidly to the application of a gain-increasing control voltage than to a gain-decreasing control voltage.

13. Apparatus in accordance with claim 9 wherein said control circuit includes first and second signal-comparing networks respectively connected between the first and second output terminals of the decoder matrix and between the third and fourth output terminals of the decoder matrix, said first and second signal-comparing networks each bein operative to compare the relative amplitudes and phase positions of the signals present at the pair of decoder matrix output terminals to which they are respectively connected, and first and second signal-combining junctions each connected to receive the output of the first and second signal-comparing networks.

14. Apparatus in accordance with claim 13, wherein each of said signal-comparing networks includes a circuit for comparing the amplitudes of the two signals applied thereto and operative to produce an output signal only in response to a difference in amplitude between the said two signals, a circuit for comparing the phase between the two signals applied thereto and operative to produce an output signals which increases from zero when the two signals are in phase to a maximum value when the two signals are 180° out-of-phase, and a gate circuit operative in response to an absence of output signal from the amplitude-comparing means to transfer an output signal, if present, from the phase-comparing means to the first and second signal-combining junctions.

15. Apparatus in accordance with claim 14, wherein the signal amplitude-comparing circuit includes means for separately rectifying the said two signals, and a third signal-combining junction operative to produce an output signal proportional to the difference in amplitude of the rectified signals.

16. Apparatus in accordance with claim 15, further including means for rectifying the output signal from the third signal-combining junction and applying the rectified output signal to the said gate circuit.

17. Apparatus in accordance with claim 16, further including means for rectifying the signal, if any, transferred by said gate circuit, and means for applying the rectified transferred signal to said first and second combining junctions.

18. Apparatus in accordance with claim 14, wherein said phase-comparing circuit includes a pair of clipping circuits to which the said two signals are respectively applied, and a further signal-combining junction to which the output signals from the clipping circuits are applied and which is operative to produce an output signal proportional to the phase displacement between the said two signals.

19. Apparatus in accordance with claim 14, further including first and second wave-shaping networks through which said two signals are respectively applied to said amplitude-comparing means and said phase-comparing means.

20. In apparatus for reproducing on four sound-reproduction devices an equal number of audio information signals contained in first and second composite signals each containing a separate one of said audio information signals as a predominant signal and the same two others of said audio information signals as subdominant signals in a predetermined phase relationship to each other, the combination comprising:

means for deriving from said first and second composite signals third and fourth composite signals which repsectively contain as a predominant signal a different one of the two subdominant signals contained in said first and second composite signals and each of which contains as subdominant signals and in said predetermined phase relationship both of the signals appearing as dominant signals in said first and second composite signals by shifting the phase of one of said first and second composite signals relative to the other by a predetermined angle and selectively combining the relatively phase-shifted first and second composite signals, signal-coupling means connected to receive and operative to couple said first, second, third and fourth composite signals to respective ones of said sound-reproducing devices, said signal-coupling means including control signal generating means including first and second phase-comparing means operative to compare the relative phase of said first and second composite signals and of said third and fourth composite signals, respectively, and to produce a first control signal when said third and fourth composite signals are out-of-phase or a second control signal when said first and second composite signals are out-of-phase, or both said first and second control signals, each of said phase-comparing means including means for clipping said composite signals, and signal amplitude-modifying means connected to be controlled by said control signals so as to increase the relative predominance of the signal or signals applied to said sound-reproduction devices which instantaneously contain audio information signals which predominate relative to the other signals applied to said sound-reproduction devices.

21. The combination in accordance with claim 20, wherein said control signal generating means further includes means for comparing the relative amplitudes of said first and second and of said third and fourth composite signals, respectively, and is operative to cause said signal amplitude-modifying means to increase the amplitude of the composite signals coupled to the first and second sound-reproduction devices when the predominant signals contained in the composite signals coupled to the third and fourth sound-reproduction devices are equal and out of phase, and to increase the amplitude of the composite signals coupled to the third and fourth sound-reproduction devices when the predominant signals contained in the composite signals coupled to the first and second sound-reproduction devices are equal and out of phase.

22. The combination in accordance with claim 21, further including first, second, third and fourth wave-shaping networks through which said first, second, third and fourth composite signals are respectively applied to their respective phase-comparing means and amplitude-comparing means.

23. In apparatus for separately reproducing on four sound-reproducing devices four audio information signals each containing a separate one of said audio information signals as a predominant signal and the same two others of said audio information signals as subdominant signals in a preselected phase relationship with each other, the combination comprising:

means for deriving from said first and second composite signals third and fourth composite signals which respectively contain as a predominant signal a different one of the two subdominant signals contained in said first and second composite signals and each of which contains as subdominant signals and in said preselected phase relationship both of the signals appearing as dominant signals in said first and second composite signals by shifting the phase of one of said first and second composite signals relative to the other by a predetermined angle and selectively combining the relatively phase-shifted first and second composite signals, signal amplitude-modifying means connected to receive and operative to couple said first, second, third and fourth composite signals to respective ones of said sound-reproducing devices, control signal generating means including first and second phase-comparing means operative to compare the relative phase of said first and second composite signals and of said third and fourth composite signals, respectively, and to produce a control signal having a polarity determined by the difference between the difference in phase between said first and second composite signals and the difference in phase between said third and fourth composite signals, and means for applying said control signal to the signal amplitude-modifying means receiving said first and second composite signals and for inverting and applying said control signal to the signal amplitude-modifying means receiving said third and fourth composite signals, said signal amplitude-modifying means being operative in response to said control signal to increase the relative predominance of the signal or signals applied to said sound-reproducing devices which instantaneously contain audio information signals which predominate relative to the other signals applied to said sound-reproducing devices.

24. Apparatus according to claim 23, wherein said control signal generating means further includes means for combining predetermined fractions of said first and second composite signals with said second and first composite signals, respectively, to produce first and second combined composite signals, and means for coupling said first and second combined composite signals to said first phase-comparing means, and means for combining predetermined fractions of said third and fourth composite signals with said fourth and third composite signals, respectively, to produce third and fourth combined composite signals, and means for coupling said third and fourth combined composite signals to said second phase-comparing means.

25. Apparatus according to claim 24, wherein said first and second phase-comparing means each includes means for sensing the zero-axis crossings of the two combined composite signals applied thereto and operative to produce respective rectangular waveform signals the leading and trailing edges of the half-cycles of each of which correspond to the zero-axis crossings in the positive-going and negative-going directions, respectively, of the respective combined composite signals, means for summing said rectangular waveform signals to produce a sum signal, and means for rectifying said sum signal and operative to produce a unidirectional signal proportional to the difference in phase of the applied combined composite signals.

26. Apparatus in accordance with claim 25, wherein said means for sensing zero-axis crossings comprises a pair of limiting amplifiers.

27. Apparatus according to claim 25, further including means for subtracting the sum signal produced by said second phase-comparing means from the sum signal produced by said first phase-comparing means and operative to produce a unidirectional control signal of a first polarity when either of said first and second combined composite signals instantaneously contains audio information signals which predominate relative to the other signals applied to said sound-reproducing devices, and to produce a unidirectional control signal of opposite polarity when either of said third or fourth combined composite signals instantaneously contains audio information signals which predominate relative to the other signals applied to said sound-reproducing devices.

28. Apparatus according to claim 27, wherein said means for applying said control signal to said signal amplitude-modifying means includes first circuit means including a first limiting amplifier having predetermined positive and negative control voltage levels and connected to couple said unidirectional control signal to the signal amplitude-modifying means receiving said first and second composite signals, and second circuit means including means for inverting said unidirectional control signal and a second limiting amplifier having said predetermined positive and negative control voltages and connected to couple said inverted unidirectional control signal to the signal amplitude-modifying means receiving said third and fourth composite signals.

29. In apparatus for reproducing on four sound-reproducing devices four directional audio information signals respectively designated $L_f$, $R_f$, $L_b$ and $R_b$ contained in first and second composite signals respectively containing to the extent they are present dominant $L_f$ and $R_f$ component signals and each including to the extent they are present subdominant $L_b$ and $R_b$ component signals, with the $L_b$ and $R_b$ component signals in one of said composite signals in quadrature relationship with the corresponding component signals in the other composite signal, the combination comprising:

means for deriving from said first and second composite signals third and fourth composite signals which respectively contain said $L_b$ and $R_b$ component signals as their predominant component and each of which contains said $L_f$ and $R_f$ component signals as subdominant components in quadrature relationship with each other by shifting the phase of one of said first and second composite signals relative to the other by about 90° and selectively combining the relatively phase-shifted first and second composite signals.

signal amplitude-modifying means connected to receive and operative to couple said first, second, third and fourth composite signals to respective ones of said sound-reproducing devices, control signal generating means including first and second phase-comparing means operative to compare the relative phase of said first and second composite signals and the relative phase of said third and fourth composite signals, respectively, and to produce a control signal having a polarity determined by the difference between the difference in phase between said first and second composite signals and the difference in phase between said third and fourth composite signals, means for applying said control signal to the signal amplitude-modifying means receiving said first and second composite signals, and means for inverting and applying said control signal to the signal amplitude-modifying means receiving said third and fourth composite signals, said signal amplitude-modifying means being controlled by said control signal so as to increase the relative prodominance of the signal or signals applied to said sound-reproducing devices which instantaneously contain audio information signals which predominate relative to the other signals applied to said sound-reproducing devices.

30. Apparatus according to claim 29, wherein said control signal generating means further includes means for combining predetermined fractions of said first and second composite signals with said second and first composite signal, respectively, to produce first and second combined composite signals, and means for coupling said first and second combined composite signals to said first phase-comparing means, and means for combining predetermined fractions of said third and fourth composite signals with said fourth and third composite signals, respectively, to produce third and fourth combined composite signals, and means for coupling said third and fourth combined composite signals to said second phase-comparing means.

31. A decoder for use in a directional sound system, wherein at least four directional audio input signals are encoded into first and second composite signals and the composite signals decoded into at least four audio output signals corresponding to said audio input signals, said composite signals each containing a separate one of said audio input signals as a predominant signal and at least the same two others of said audio information signals as subdominant components, said decoder comprising:

decoding circuit means for converting said first and second composite signals into four output signals, each of said output signals containing a predominant component corresponding to a different one of said audio input signals and at least two subdominant components, means including phase measuring means for generating first and second control signals having amplitudes related to the directional predominance of the audio input signals contained in said first and second composite signals, and means for controlling said decoding circuit means in accordance with said control signals so as to increase the predominance of the output signal or signals which instantaneously contain audio input signals which predominate relative to the other output signals.

32. A decoder for use in a directional sound system wherein at least four directional audio input signals are encoded into first and second composite signals and the two composite signals are decoded into at least four audio output signals corresponding to said audio input signals, said composite signals each containing a separate one of said audio input signals as a predominant signal and the same two others of said audio input signals as subdominant signals in preselected amplitude and phase relationship with each other, said decoder comprising:

control signal generating means including phase measuring means responsive to the directional predominance of individual ones of the audio input signals contained in said first and second composite signals for producing first and second control signals, and circuit means having first and second input terminals connected to receive said first and second composite signals, respectively, and first, second, third and fourth output terminals, said circuit means including matrix means connected to said input terminals for producing four audio output signals each containing a predominant component corresponding to a different one of said audio input signals and at least two subdominant signals and signal-modifying means connected to receive said four audio output signals for coupling said output signals to respective ones of said first, second, third and fourth output terminals, said signal-modifying meand being responsive to said first and second control signals for modifying said output signals so as to increase the predominance of the output signal or signals which contain audio signals which predominate relative to the other output signals.

33. Apparatus according to claim 32, wherein said means responsive to the directional predominance of individual ones of the audio input signals contained in said first and second composite signals includes first and second phase-comparing means respectively operative to compare the relative phase of said first and second output signals and the relative phase of said third and fourth output signals and to produce a control signal having a polarity determined by the difference between the difference in phase between said first and second output signals and the difference in phase between said third and fourth output signals.

34. Decoding apparatus for use in a directional sound system wherein at least four directional audio input signals are encoded into first and second composite signals and the two composite signals are decoded into at least four audio output signals corresponding to said audio input signals, said composite signals each containing a separate one of said audio input signals as a predominant signal and the same two other ones of said audio input signals as subdominant signals in preselected amplitude and phase relationship with each other, said decoding apparatus comprising:

matrix decoding means for converting said first and second composite signals into four output signals, each of said output signals containing a predominant component corresponding to a different one of said audio input signals and at least two subdominant components, signal amplitude-modifying means connected to receive said four output signals, control signal generating means including means for measuring the phase relationship between first and second of said output signals and between third and fourth of said output signals for generating a control signal having a polarity determined by the difference between the difference in phase between said first and second output signals and the difference in phase between said third and fourth output signals, said control signal being a measure of the directional predominance of the audio input signals contained in said first and second composite signals, and means for applying said control signal with one polarity to the signal amplitude-modifying means receiving said first and second output signals and with the opposite polarity to the signal amplitude-modifying means receiving said third and fourth output signals, said signal amplitude-modifying means being controlled by said control signal so as to increase the predominance of the output signal or signals which contain audio signals which predominate relative to the other output signals.

35. Decoding apparatus in accordance with claim 34, wherein the means for measuring the phase relationship between the first and second output signals and between the third and fourth output signals each comprises:

phase-comparing means to which said output signals are applied and including means for sensing the zero-axis crossing of the two applied signals and operative to produce respective rectangular waveform signals, the leading and trailing edges of the half-cycles of each of which correspond to the zero-axis crossings in the positive-going and negative-going directions, respectively, of said signals, means for summing the rectangular waveform signals, and means for rectifying the output of the summing means to produce a unidirectional control signal proportional to the difference in phase of the output signals applied to the phase-comparing means.

* * * * *